US006024835A

United States Patent [19]

Fiore et al.

[11] Patent Number: 6,024,835

[45] Date of Patent: Feb. 15, 2000

[54] QUALITY CONTROL APPARATUS AND METHOD FOR PAPER MILL

[76] Inventors: Leonard F. Fiore, 11610 45th St., NE., Foley, Minn. 56329; Gregory P. Brandl, 41355 County Rd. 3, Holdingford, Minn. 56340; Allen R. Voit, 841 2nd Ave. North, Sauk Rapids, Minn. 56379; Michael J. Krouze, 1209 13th Ave. SE., St. Cloud, Minn. 56304

[21] Appl. No.: 07/936,507

[22] Filed: Aug. 28, 1992

[51] Int. Cl.[7] ..... D21G 9/00

[52] U.S. Cl. ..... 162/198; 162/DIG. 10

[58] Field of Search ..... 162/198, DIG. 10; 364/471, 132, 184, 131, 468.16, 468.17, 471.02, 471.03

[56] References Cited

U.S. PATENT DOCUMENTS

| | | | |
|---|---|---|---|
| 4,304,001 | 12/1981 | Coper | 364/132 |
| 4,604,686 | 8/1986 | Reiter et al. | 364/200 |
| 4,698,776 | 10/1987 | Entwistle et al. | 364/132 |
| 4,827,423 | 5/1989 | Beasley et al. | 364/468 |

OTHER PUBLICATIONS

John Lavigne, "An Introduction To Paper Industry Instrumentation", 1972, pp. 402–415.

Don Wayne, "An Approach to Distributed Computer Control in An Integrated Pulp Mill", Tappi, Jun. 1981, pp. 109–113.

*Primary Examiner*—Dean T. Nguyen

[57] ABSTRACT

A quality control apparatus and method are provided for a paper mill. The apparatus includes at least one lab entry station which communicates directly with each laboratory in a paper mill. Information from each laboratory is validated by the lab entry station. The apparatus also includes a gateway entry station which receives information from on-line systems in the paper mill and reformats the received information into a single useable format. A global data base manager communicates with the lab entry station and the gateway entry station identifies each bit of information received and assigns addresses for the identified information. A communication manager is provided to transmit the received information from the global data base manager to operator stations. Operator stations provide user interfaces throughout the paper mill at which data can be displayed and analyzed. In this manner various locations throughout a paper mill can assess their own ability to conform to specifications and operational standards. Additionally, at least selected locations in the paper mill can assess the impact of performance at one location in the paper mill on results at other locations.

11 Claims, 5 Drawing Sheets

QUALITY CONTROL APPARATUS AND METHOD FOR PAPER MILL

BACKGROUND OF THE INVENTION

A typical prior art paper mill is illustrated schematically and very generally in FIG. 1, and is identified by the numeral 10. The prior art paper mill 10 receives a variety of raw materials at location 12, including wood, wood byproducts and recycled paper. These raw materials are mixed with chemicals at location 14 to create a pulp slurry. The raw materials and pulping chemicals used in the prior art paper mill 10 may vary from time to time in accordance with the type of paper being produced. Similarly, the types of chemical processes performed on the pulp at location 14 will vary in accordance with the type of paper being produced. The pulp is then processed and dried to produce the specified paper in the paper production facilities 18. Liquid portions of the original pulp slurry become byproducts of the paper manufacturing process and must be appropriately treated prior to disposal. The finished paper typically is wound onto large rolls for temporary storage at location 22 and for transportation to another facility where the paper will be cut, printed, folded and/or packaged in accordance with its specified end use.

Laboratory analyses are carried out in the prior art paper mill 10 to ensure that the mill is functioning properly and to ensure that the paper being produced by the prior art mill 10 conforms with specifications. These tests may start with the raw materials at location 12 to quantify certain characteristics, including moisture content, chemical composition, weight and such. Many more analyses are carried out as part of the pulping process, including assessments of consistency, fiber content, acidity, chemical composition and color. These tests typically will be performed on samples removed periodically from the pulp processing facilities 14 of the prior art paper mill 10 and analyzed at an off-line pulp laboratory 16. Results may be tabulated and periodically reported to supervisory personnel. The pulp laboratory 16 in a prior art paper mill 10 will include sophisticated analytical machines and special purpose computers for testing pulp samples, analyzing test results and tabulating or printing the test results into some usable format.

The pulp processing facilities 14 of the prior art paper mill also include certain on-line data collectors and analyzers. For example, pulping machinery may be operative to measure temperature, pressure, flow rate and holding time at various locations in the pulp processing facilities 14 of the prior art paper mill 10. On-line controls for the pulp processing facilities 14 may be operative to assemble, collate and report on certain operational conditions of the pulp processing equipment.

Tests are further performed on the paper produced by the prior art mill 10 to assess brightness, opacity, color, moisture content, tear strength, burst strength and such. Many of these tests are performed off-line in a paper lab 22 which employs special purpose computer aided test equipment for analyzing and reporting test results. Other tests may be performed on-line in the paper production facilities 18 of the prior art paper mill 10 to assess, for example, brightness, color or smoothness. On-line processing equipment may be operative to periodically report and analyze these data to the machine operator at that particular on-line location.

The prior art paper mill 10 may further require analysis of conditions relating to the treatment and disposal of waste materials. For example, the treatment of waste material may vary in accordance with environmental conditions, such as wind speed, temperature and atmospheric pressure. Waste treatment should also vary in accordance with the actual condition of the waste. Thus, some characteristics of the waste are analyzed in an off-line laboratory based on samples collected from the waste.

Technicians working in the prior art paper mill 10 typically have areas of specialty which define the locations in the paper mill to which the technicians are assigned. Technicians in each section typically requisition and purchase apparatus for data collection, analysis and reporting that is best suited to their particular responsibilities in the prior art paper mill 10. Hence, data collection, analysis and reporting equipment at one location often are incompatible with equipment at other locations in the prior art paper mill 10. Information produced in these various analyses travel along limited established channels of communication. However, there often is little cross flow of information throughout the prior art paper mill 10. Thus, the technician working in the pulp lab might have little contact with analyses being performed by the technician in the paper lab, and neither would have access to on-line data collection, such as production rates. Even within established communication channels, the flow of usable information would depend upon the ability of technicians to produce test reports in a timely manner. Decision makers in the prior art paper mill 10 might not have the simultaneous access to data required to make a well reasoned decision. Furthermore, decision makers in the prior art paper mill 10 often receive data in separate incompatible formats, and the reformatting required for assessing system performance often is unfeasible.

A failure to identify or respond to an operational inefficiency in the prior art paper mill 10 is likely to affect the quality of the paper being produced. A finished roll of paper that is found to be inadequate in some respect (e.g, tear strength, burst strength or color) may require recycling at a substantial cost penalty and with a corresponding inefficient use of manufacturing equipment in the prior art paper mill 10.

In view of the above, it is an object of the subject invention to provide apparatus for more readily assessing and assuring the quality of paper produced by a paper mill.

Another object of the subject invention is to provide an efficient method for assuring quality performance of an entire paper mill.

Still a further object of the subject invention is to provide an apparatus and a method for achieving efficient flow of information and analyses for use throughout a paper mill.

SUMMARY OF THE INVENTION

The subject invention is directed to apparatus for enhancing and controlling quality throughout a paper mill. The apparatus includes computers and data processing means which cooperate with existing pulp or paper processing equipment and existing computers in laboratories of the paper mill to collect data, reformat the collected data and route the data to selected locations in the paper mill for use, as needed by technicians and operators of the paper mill.

The apparatus of the subject invention includes at least one lab entry station in communication with each of the respective laboratories of the paper mill. The lab entry stations receive and validate information from each laboratory for subsequent use as explained herein. For example, a lab entry station may communicate with the pulp laboratory for receiving information relating to color, consistency, acidity, fiber content and chemical composition. Similarly, the lab entry station may receive information from the paper laboratory regarding tear strength, burst strength, porosity and brightness. The entered and validated information from each lab entry station may be transmitted to a global data base manager for further analysis and subsequent retrieval, as explained herein. The global data base manager then transmits the data to multiple operator stations and archives in the paper mill. For example, at least portions of the information gathered at the lab entry stations may be archived for subsequent trend analysis and/or for production of hard copy reports.

The apparatus of the subject invention further includes at least one gateway entry station communicating with on-line systems of the paper mill, including the raw material input, the pulp making facilities and the paper making facilities. For example, a gateway entry station may receive data defining temperature, pressure, flow rates, holding times and acidity from pulp making facilities in the paper mill. Similarly, the gateway entry station may receive information regarding production rates, color, brightness, or moisture content from the paper making facilities. Still further, the gateway entry station may receive environmental data such as temperature, wind speeds and barometric pressure. The gateway entry station may collect information in a plurality of different formats and then convert the collected information into a common format.

A global data base manager is in communication with at least one gateway station and may further be in communication with at least one lab entry station. The global data base manager identifies the collected information from the gateway entry station and/or the lab entry station and determines appropriate addresses or destinations for the identified data. Information may be stored in the global data base manager in accordance with its potential destinations, so that the information may subsequently be recalled and utilized as needed.

Archives may further be provided in communication with the global data base manager. The archives may be used to store information that is not immediately transmitted from the global data base manager to operator stations throughout the paper mill and/or to other sites in the paper mill. For example, archived data may be used to analyze trends or saved for subsequent use in hard copy reports.

The apparatus of the subject invention may further comprise a communications manager communicating with each global data base manager for controlling transmission of data from the global data base manager to specified destinations throughout the paper mill in accordance with the address determinations made by the global data base manager.

Operator stations are disposed throughout the paper mill and provide the primary user interface with the apparatus of the subject invention. The operator stations communicate with the global data base manager to initiate requests for information from the global data base manager. Each operator station will have access to at least the information in the global data base that is required for efficient quality control of the portion of the paper mill at which the particular operator station is located. The particular information made available to each operator station is determined by prior programming of the global data base manager. Each operator station is able to analyze and display the information available to it in each of various graphic or textual formats. Preferably each operator station is further able to display a plurality of different data arrays simultaneously. Multiple displays may be enabled by windows in the display apparatus of each operator station. For example, an operator may control the size, location and geometry of each window and specify graph types to be executed in each window, as well as various parameters to control the information being presented. In this manner, the operator can dynamically build a customized display and thereby create or modify the look, feel and functionality of each display in accordance with the information being analyzed and the location in the paper mill.

The apparatus of the subject invention enables operators at locations throughout a paper mill to have access to information that otherwise would not immediately be available at their particular location. The apparatus further enables the information to be analyzed virtually instantaneously so that operational parameters of the paper mill can be adjusted as needed to insure virtually continuous conformance with specified operational parameters.

The subject invention further is directed to a method for assuring quality control in a paper mill. The method includes collecting, validating and reformatting information from at least one laboratory in the paper mill. The method further includes collecting and reformatting information received from on-line measurement means. A further step of the method includes transmitting the collected information from the laboratories and from the on-line machines in the paper mill to a global data base. The method proceeds by identifying destinations for the various collected information and archiving at least selected portions of the collected information. The method of the subject invention continues by communicating the collected information to selected destinations in the paper mill in accordance with the destination instructions of the global data base. Finally, the method includes the steps of analyzing and presenting the data at each of a plurality of operator stations in the paper mill.

DETAILED DESCRIPTION OF THE PREFERRED EMBODIMENT

Figure 1:
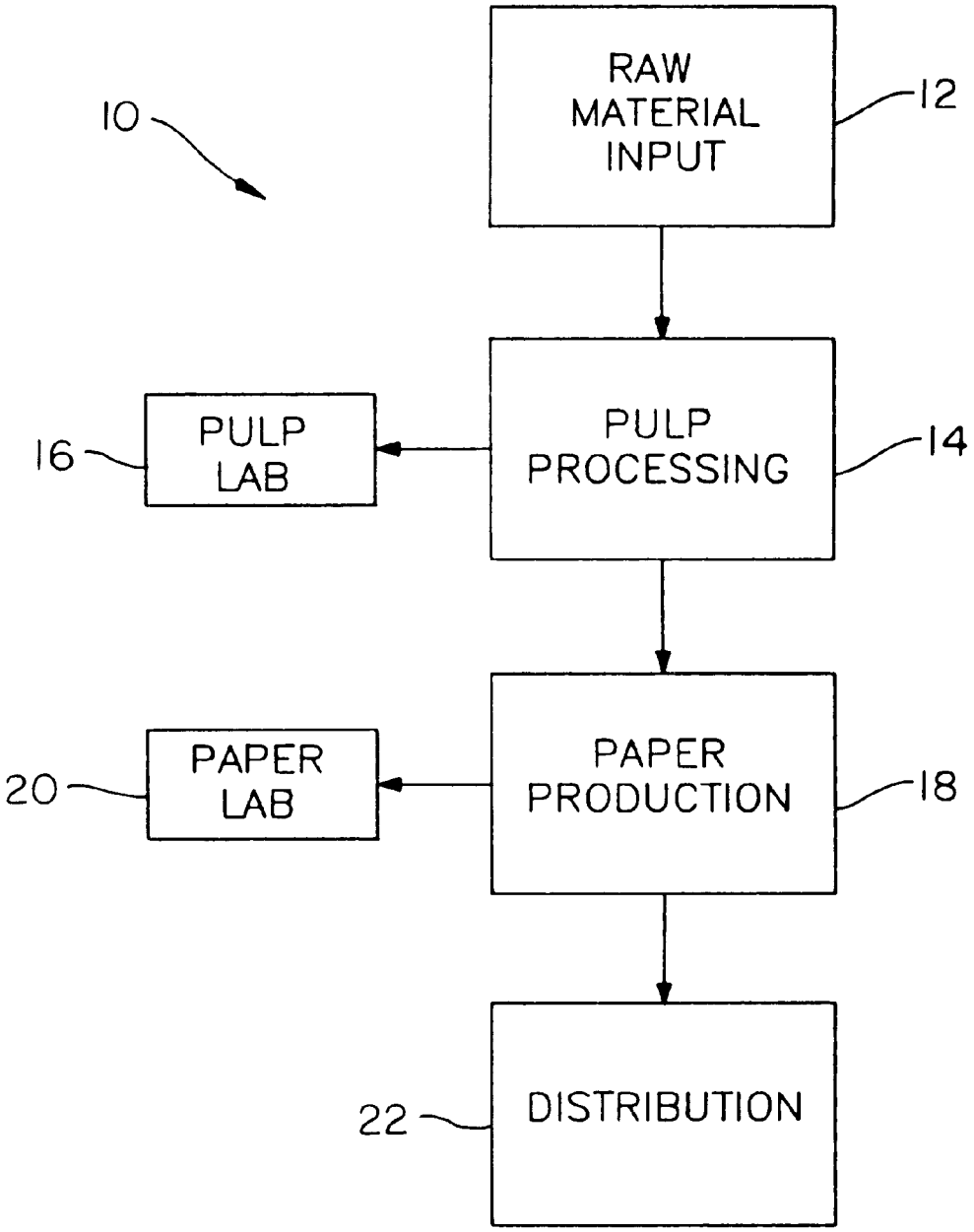
FIG. 1 (PRIOR ART)
FIG. 1 is a schematic illustration of a prior art paper mill.
Figure 2:
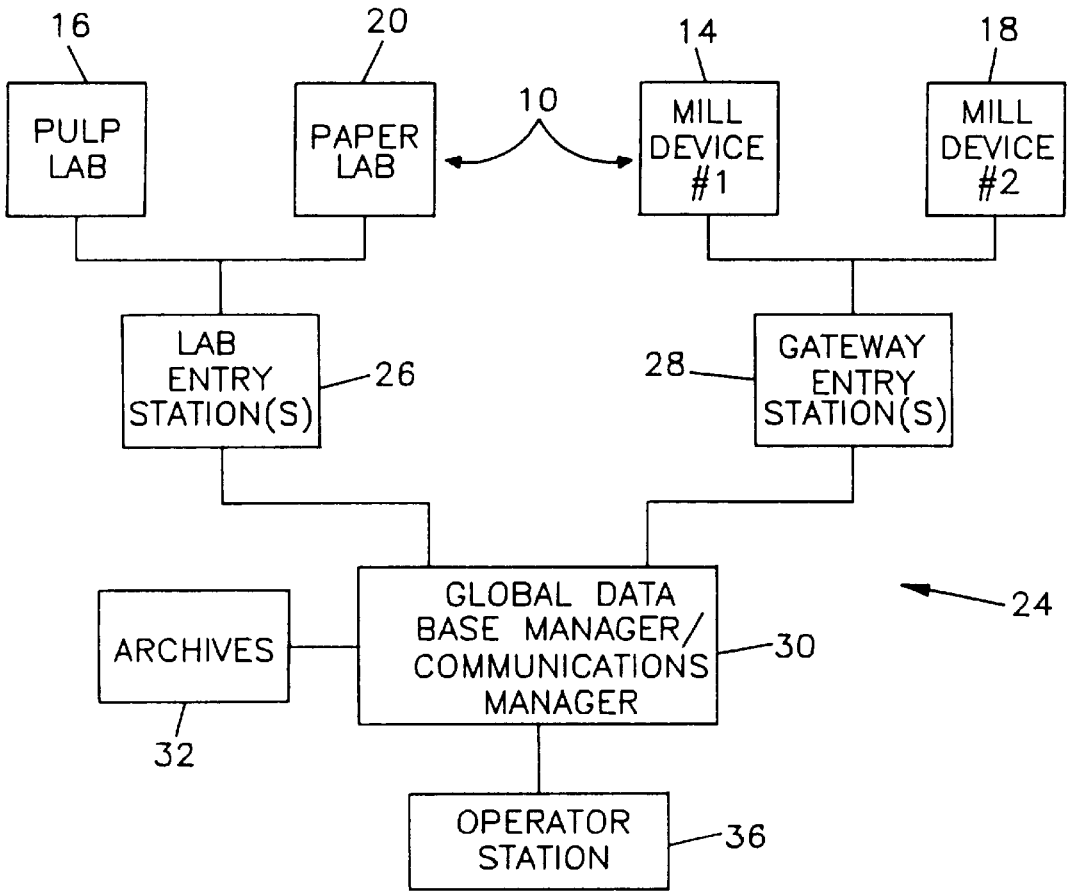
FIG. 2 is a schematic illustration of the quality control apparatus in accordance with the subject invention.

A quality control apparatus in accordance with the subject invention is identified generally by the numeral 24. The quality control apparatus 24 is operative to receive information from a plurality of locations in a prior art paper mill 10, as shown in FIG. 1, to reformat the received information and to distribute the reformatted information to various locations in the prior art paper mill 10 for subsequent analysis and use as explained herein.

The quality control apparatus 24 includes a lab entry station 26 in communication with the pulp lab 16 and the paper lab 20 of the prior art paper mill 10. The lab entry station 26 may further communicate with any other laboratories that may be incorporated into the prior art paper mill 10. The lab entry station 26 is a computer which preferably is hard-wire connected to the various testing apparatus in the pulp lab 16, the paper lab 18 and any other laboratories that may exist in the prior art paper mill 10. Thus, results of analyses performed in the pulp lab 16 and the paper lab 20 will be sent directly to the lab entry station 26. Additionally, the pulp lab 16, the paper lab 20 and any other laboratories existing in the prior art paper mill may include at least one data input terminal to enable manually assembled data to be inputted to the lab entry station 26. The lab entry station 26 is further operative to validate the information received from the pulp and paper labs 16 and 20 prior to transmitting the received information to other components of the quality control apparatus 24 and/or to other locations in the prior art paper mill 10.

The quality control apparatus 24 further includes a gateway entry station 28 in communication with the pulp processing facilities 14 of the prior art paper mill 10 and further in communication with the paper production facilities 18 of the prior art paper mill 10. In particular, the gateway entry station 28 is directly connected to on-line equipment in the prior art paper mill 10 for assessing various parameters defining the performance of the prior art paper mill. With respect to the pulp processing facilities 14 of the prior art paper mill 10, information such as acidity, temperature, pressure, flow rates, holding times and fiber content will be transmitted to the gateway entry station 28. Similar data from the paper production facilities 18 of the prior art paper mill are transmitted from the on-line location of the paper production facilities 18 to the gateway entry station 28. These data transmitted to the gateway entry station 28 may include paper production rates, brightness of the paper, thickness of the paper, color and moisture content. The gateway entry station 28 may further communicate with other portions of the prior art paper mill 10. In particular, the gateway entry station 28 may communicate with on-line systems for quantifying environmental conditions. For example, continuous information regarding outside temperature, wind speed, wind direction, barometer and wind chill may be reported for use in assessing various aspects of the paper mill performance, including those aspects affecting the external environment or affected by the external environment. In particular, waste treatment may vary in accordance with external climatic or environmental conditions. The gateway entry station 28 receives information from these various locations in the prior art paper mill 10 in a format appropriate for the respective on-line data transmitter, and converts the inputted information into a common format. Thus, in effect, the gateway entry station 28 functions as a single shared memory for the various on-line information reporting stations and performs a master interpretation program to achieve a common format for all of the inputted information.

The quality control apparatus 24 further includes a global data base manager/communications manager 30 in the form of a computer communicating with both the lab entry station 26 and the gateway entry station 28. The global data base manager is a library of routines which receives and identifies information from the lab entry station 26 and the gateway entry station 28 and determines addresses of the prior art paper mill 10 to which the received information is relevant. Some information received by the global data base manager may have only a single address encoded by the global data base manager. Other information, however, will be universally distributed throughout the prior art paper mill 10, while still other information may be encoded for selected distribution addresses.

The quality control apparatus 24 further includes an archive 32 in electronic communication with the global data base manager 30 for receiving and storing at least selected encoded information therefrom. Information stored in the archive 32 may be accessed as needed by the global data base manager 30.

Information is distributed from the global data base manager/communications manager 30 to selected locations in the prior art paper mill 10 in accordance with the addresses encoded by the global data base manager. The communications manager is an application program which uses a highly reliable connection oriented protocol (TCP/IP) with multiple clients and servers. In particular, the communications manager is operative to read the vector encoded by the global data base manager to identify each potential address for information in the global data base manager. The communications manager effectively creates a background process for each active or participating site in the quality control apparatus 24 used in the paper mill 10. These processes will continuously check the distribution vector encoded by the global data base manager to see if there are any messages bound for each particular site participating in the quality control apparatus 24. Identified messages will be sent by the communication manager to the appropriate participating location and the vector stored in the global data base manager/communication manager 30 will be modified as necessary to indicate transmission of the stored data.

Figure 3:
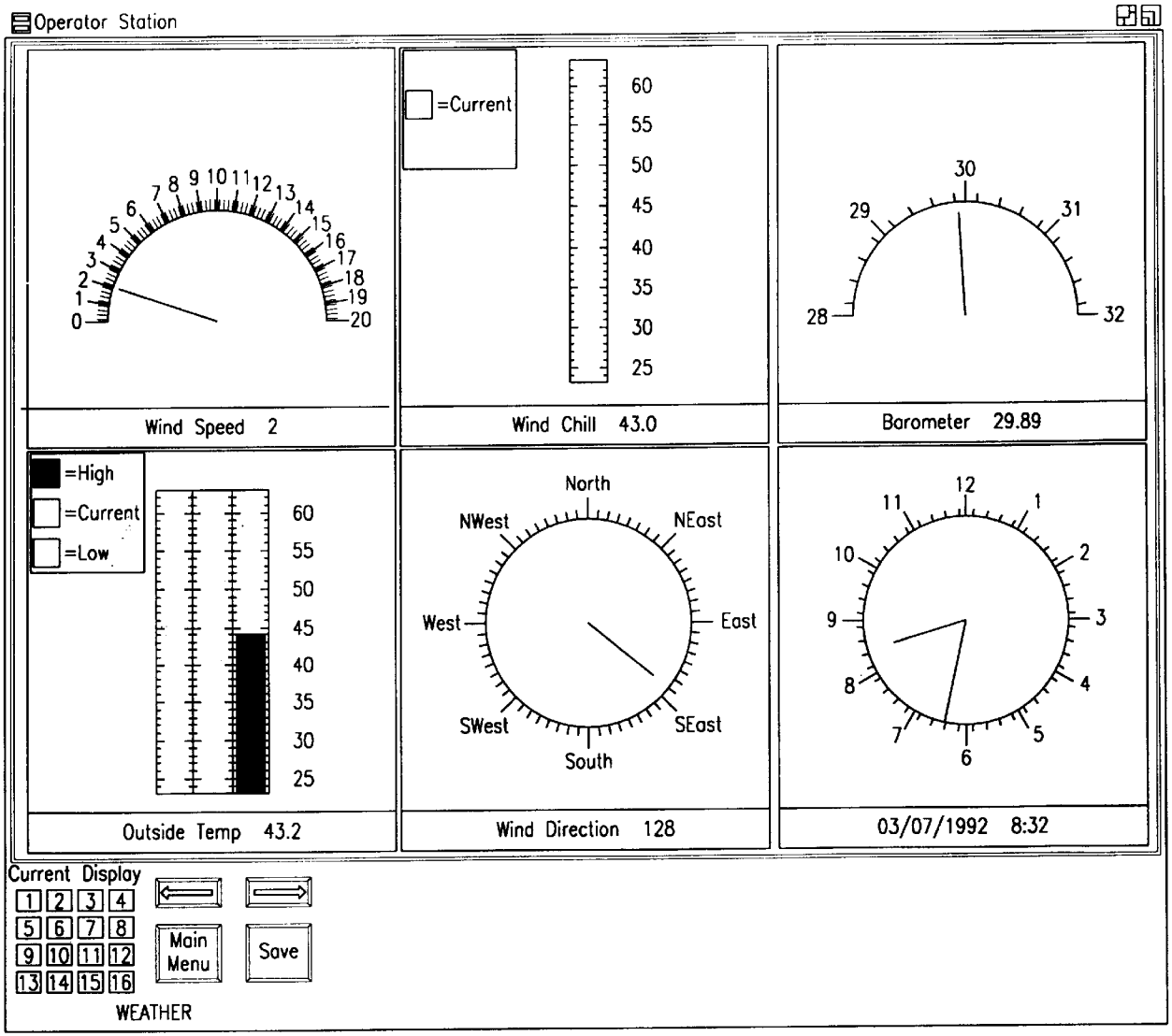
FIG. 3 is a graphic display of information outputted by an operator station of the apparatus shown in FIG. 2.

Operator stations 36, only one of which is shown, are the primary user interface to the quality control apparatus 24 of the subject invention. In particular, each operator station 36 includes at least one terminal which enables users to graphically display information transmitted by the global data base manager/communications manager 30. Each operator station 36 further provides a set of standards by which other modules can interact with it. The information transmitted to each operator station 36 may be manipulated, analyzed and displayed in various graphic and textual formats. In a preferred embodiment, each operator station 36 may enable a large number of windows to be displayed simultaneously for various types of information or for various graphic presentations of a selected type of information. For example, FIG. 3 shows a six-window display at an operating station wherein all windows relate to climatic conditions, including wind speed, wind chill, barometer, outside temperature, wind direction and time. It will be noted that FIG. 3 displays the information both graphically and numerically.

Figure 4:
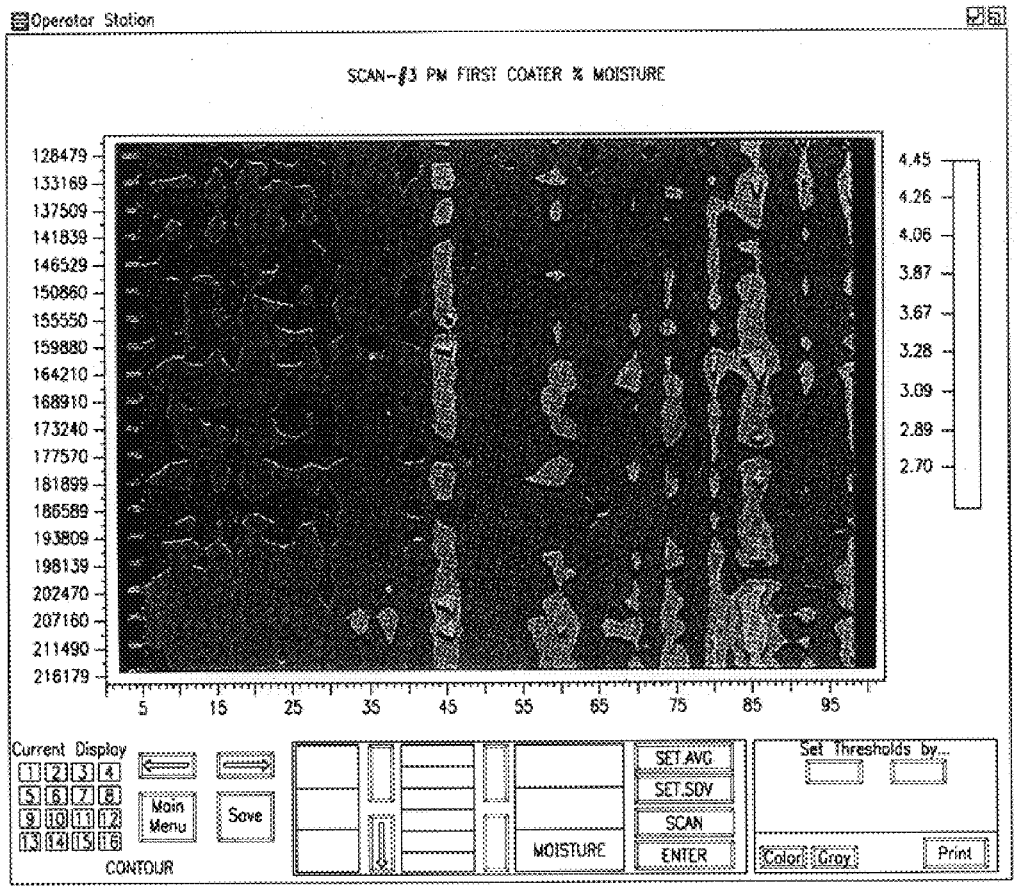
FIG. 4 is a second graphic display of information outputted by the operator station.

FIG. 4 is a graphic representation by an operator station 36 of percent moisture as measured at a coater in the paper production facilities of the mill for various locations across the width of the paper being produced and for various locations along the length of the paper. This particular graph as shown in FIG. 4 displays that moisture characteristics are different along one side of the paper than along the other side. Appropriate modifications to the coater may be made based on the information presented graphically in FIG. 4.

Figure 5:
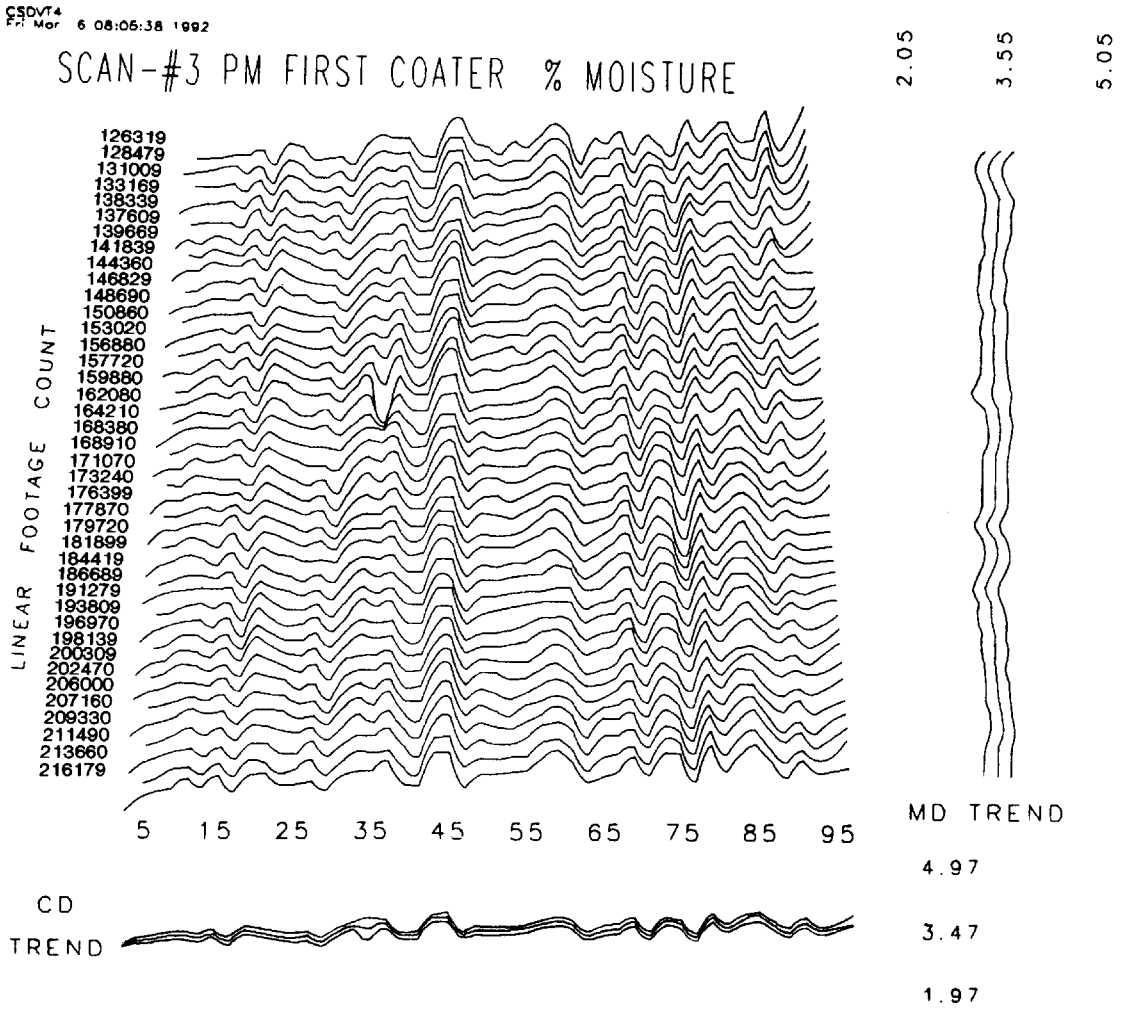
FIG. 5 is a third graphic display of information outputted by the operator station.

FIG. 5 shows a different presentation of data by the operator station 36 for moisture at a particular coater of the paper production facilities in the mill. This FIG. 5 graphic presentation also shows differences between the left and right sides of the paper and further shows trends. A user of the quality control apparatus 24 can switch from one display type to another in accordance with the particular analytical needs at that moment.

The quality control apparatus 24 of the subject invention enables technicians throughout the prior art paper mill 10 to have virtually immediate access to all information collected in the paper mill that may be remotely relevant to their part of the paper mill operation. Operators may quickly change from one information analysis to another and may simultaneously display, reformat and analyze plural types of information simultaneously. In this manner, operators can analyze the effects of operational changes at one location in the system on performances at other locations in the system. Additionally, technicians can make operational changes throughout the system to ensure conformance to specifications.

The method of the subject invention includes inputting information from each laboratory 16, 18 in a paper mill 10 to lab entry stations 26. Similarly, information from each on-line system is inputted to a single gateway entry station 28. The gateway entry station is operative to reformat the received information into a single useable format. The method further includes transmitting the information from both the lab entry station and the gateway entry station to a global data base manager 30. At the global data base manager, the method proceeds by identifying the information received and further assigning one or more appropriate addresses for the information based on the identification. Selected information received by the global data base manager may be communicated to archives 32 for subsequent retrieval. The method further includes the step of sending information to appropriate operator stations 36 in accordance with the addresses assigned by the global data base manager 30. Finally, the method includes displaying and analyzing the information transmitted to each operator station 36.

While the invention has been described with respect to preferred embodiments, it is apparent that various changes can be carried out without departing from the scope of the invention as defined by the appended claims.

We claim:

1. A method for controlling quality of paper produced by a paper mill, said paper mill having pulp processing facilities, paper production facilities, at least one pulp lab and at least one paper lab, said method comprising the steps of:

transmitting lab information from each said lab to a lab entry station;

validating the lab information received by each said lab entry station;

transmitting operational information from the pulp processing facilities and the paper production facilities to a gateway entry station;

reformatting the operational information in the gateway entry station into a common format;

transmitting the validated lab information and the reformatted operational information to a global data base manager;

identifying each item of information received in the global data base manager;

assigning at least one address to each item of information received by the global data base manager based on the identification of each said item of information;

transmitting information from the global data base manager to each of the assigned addresses; and, displaying the transmitted information at each said address and transmitting displayed information to other addresses requiring such information to affect quality and to prevent defects in a timely manner.

2. A method as in claim 1 further comprising archiving at least selected information transmitted to the global data base manager.

3. A method as in claim 1 further comprising the step of selectively reformatting the displayed information transmitted to each said address.

4. A quality control apparatus for a paper mill having on-line apparatus for making pulp and paper, data collectors for collecting operational data from the on-line apparatus and at least one off-line laboratory for evaluating samples taken from the on-line apparatus, said quality control apparatus comprising:

at least one lab entry station communicating with the off-line laboratory for receiving [information] data therefrom;

at least one gateway entry station communicating with the data collectors for receiving the collected operational data from the on-line apparatus and reformatting the collected operational data into a single format;

a global data base manager communicating with each said lab entry station and each said gateway entry station for receiving data therefrom, identifying the received data and assigning at least one address to each item of the received data;

a communications manager communicating with the global data base manager for sending data to each address identified by the global data base manager; and a plurality of operator stations disposed in proximity to the respective addresses in the paper mill and being in communication with the global data base manager, each said operator station being operative to display data communicated thereto and capable of correlating and reformatting said data to analyze the effects of operational changes at one location in the mill on performance at that location or at other locations in the mill and being operative to make operational changes throughout the mill to insure conformance to specifications.

5. A quality control apparatus as in claim 4 wherein the paper mill includes a pulp laboratory and a paper laboratory, the lab entry station communicating with both the pulp laboratory and the paper laboratory.

6. A quality control apparatus as in claim 5 wherein the lab entry station receives information defining tear strength, acidity and fiber content.

7. A quality control apparatus as in claim 4 wherein the lab entry station comprises means for validating information received from the laboratories.

8. A quality control apparatus as in claim 4 wherein the paper mill includes a pulp processing facility and a paper production facility, the gateway entry station communicating with both the pulp processing facility and the paper production facility.

9. A quality control apparatus as in claim 8 wherein the gateway station receives information relating to moisture content, brightness, color, paper production rates and acidity.

10. A quality control apparatus as in claim 8 wherein the paper mill includes means for collecting climatic data, and wherein the gateway entry station is operative to receive the climatic information and to communicate the climatic information to the global data base manager for use in the treatment of waste material produced in the pulp processing and paper production facilities.

11. Apparatus located in a paper mill for controlling quality of paper produced by a paper mill, said paper mill having pulp processing facilities, paper production facilities, at least one pulp lab and at least one paper lab, said apparatus comprising:

at least one lab entry station;

means for transmitting lab information from each said lab to a lab entry station, each said lab entry station comprising means for validating the lab information received by it;

a gateway entry station;

means for transmitting operational information from the pulp processing facilities and the paper production facilities to said gateway entry station, said gateway entry station comprising means for reformatting the operational information therein into a common format;

a global data base manager;

means for transmitting the validated lab information and the reformatted operational information to said global data base manager, said global data base manager comprising means for identifying each item of information received therein and for assigning at least one address to each item of information received therein based on the identification of each said item of information;

means for transmitting information from the global data base manager to each of the assigned addresses; and, means for displaying the transmitted information at each said address.

* * * * *